US008636540B2

(12) United States Patent
Bu

(10) Patent No.: US 8,636,540 B2
(45) Date of Patent: Jan. 28, 2014

(54) ELECTRICAL CONNECTOR GROUNDING PATH TO OUTER SHELL

(75) Inventor: Jian-Ming Bu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 319 days.

(21) Appl. No.: 13/092,333

(22) Filed: Apr. 22, 2011

(65) Prior Publication Data

US 2011/0263157 A1 Oct. 27, 2011

(30) Foreign Application Priority Data

Apr. 23, 2010 (CN) ..... 2010 1 0154121

(51) Int. Cl.
*H01R 13/648* (2006.01)

(52) U.S. Cl.
USPC ..... 439/490; 439/607.26

(58) Field of Classification Search
USPC ..... 439/607.26, 607.38, 490, 541.5, 439/620.18, 620.19
See application file for complete search history.

(56) References Cited

U.S. PATENT DOCUMENTS 3,871,728 A * 3/1975 Goodman ..... 439/62
5,639,267 A * 6/1997 Loudermilk ..... 439/701
5,759,067 A * 6/1998 Scheer ..... 439/607.26
6,139,364 A * 10/2000 Beutler et al. ..... 439/607.01
6,352,446 B2 3/2002 Ezawa
6,511,348 B1 * 1/2003 Wojtacki et al. ..... 439/620.18
6,565,391 B2 * 5/2003 Bernstein et al. ..... 439/701
6,572,411 B1 * 6/2003 Aeschbacher et al. ... 439/620.21
6,699,071 B1 * 3/2004 Hyland ..... 439/607.19
6,729,906 B1 * 5/2004 Simmons et al. ..... 439/607.26
6,739,915 B1 * 5/2004 Hyland et al. ..... 439/676
6,749,467 B2 * 6/2004 Korsunsky et al. ..... 439/676
6,835,092 B2 * 12/2004 Wan et al. ..... 439/541.5
6,962,511 B2 11/2005 Gutierrez
7,018,242 B2 * 3/2006 Brown et al. ..... 439/676
7,033,210 B1 * 4/2006 Laurer et al. ..... 439/541.5
7,121,898 B2 * 10/2006 Murr et al. ..... 439/676
7,153,158 B1 * 12/2006 Lee ..... 439/541.5
7,261,592 B2 * 8/2007 Korsunsky et al. ..... 439/541.5
7,300,307 B2 * 11/2007 Murr et al. ..... 439/540.1
7,367,851 B2 * 5/2008 Machado et al. ..... 439/676
7,611,383 B1 * 11/2009 Huang ..... 439/620.17
7,712,941 B2 * 5/2010 Tai et al. ..... 362/581
7,717,749 B2 * 5/2010 Chen et al. ..... 439/620.22
7,775,828 B2 * 8/2010 Zhang ..... 439/540.1
7,909,643 B2 * 3/2011 Pepe et al. ..... 439/540.1
8,043,112 B2 * 10/2011 Filipon et al. ..... 439/485
8,272,877 B2 * 9/2012 Stokoe et al. ..... 439/55
8,337,246 B2 * 12/2012 Zhang ..... 439/607.01

* cited by examiner

*Primary Examiner* — Neil Abrams
(74) *Attorney, Agent, or Firm* — Ming Chieh Chang; Wei Te Chung

(57) ABSTRACT

An electrical connector (100) comprising a housing (200) defining a front face and a first mating cavity recessed rearward from the front face for receiving a modular plug, an electronic module (400) mounted to the housing, a horizontal PCB (500) mounted under the electronic module, and an outer shell (700) shielding the electronic module and the housing. The electronic module has a vertical PCB(420) which includes a ground trace (421) joined to a conductor (427) that extends through a plated hole in the vertical PCB and that is connected to a conductive pin (722) of the outer shell through a conductive trace (56) of the horizontal PCB (500).

10 Claims, 5 Drawing Sheets

ELECTRICAL CONNECTOR GROUNDING PATH TO OUTER SHELL

BACKGROUND OF THE INVENTION

1. Field of the Invention

The present invention relates to a modular jack, and particularly, to a grounding trace of the modular jack.

2. Description of Related Art

U.S. Pat. No. 6,729,906, issued to Simmon et al. on May 4, 2004, discloses an electrical connector having an electronic module (or modules), an outer shell and a light emitting device (or devices). The electronic module includes a vertical component (printed circuit) board and a separated decoupling capacitor and an electrical path is established from the capacitor through a grounding clip extending through a through-hole, where it is grounded through a trace on the board, on the one hand, and through an intermediate and a lower shields to the outer shell on the other hand. The light emitting device is located beside the electronic module or between adjacent modules.

U.S. Pat. No. 6,962,511, issued to Gutierrez et al. on Nov. 8, 2005, discloses an electrical connector having an electronic module, an outer shell and a light emitting device. Also disclosed are a vertical, primary component board and a secondary bottom board or substrate with perforations for lower conductors from the primary board to penetrate therethrough for mechanical stability and registration. The footprint of the light emitting device is located behind the electronic module and the light emitting device is disposed outside the outer shell. There is no disclosure about grounding path or trace from the electronic module to the outer shell. Disposing light emitting device inside an outer shell can be seen, for example, in U.S. Pat. No. 6,352,446.

An object of present invention is to provide an electrical connector having an electronic module, a light emitting device having footprint located behind the electronic module, and an outer shell covering outside of the light emitting device and the electronic module and electrically connecting the electronic module.

SUMMARY OF THE INVENTION

An object of the present invention is to provide an electrical connector comprising a housing defining a front face and a first mating cavity recessed rearward from the front face for receiving a modular plug, an electronic module mounted to the housing, a horizontal PCB mounted under the electronic module, an outer shell shielding the electronic module and the housing. The electronic module has a first ground trace connects the outer shell through a first conductive trace of the horizontal PCB.

Still another object of the present invention is to provide an electrical connector comprising a housing defining a front face and a first mating cavity recessed rearward from the front face for receiving a modular plug, an electronic module mounted to the housing, a horizontal PCB mounted under the electronic module, an outer shell shielding the electronic module. The outer shell has a vertical rear wall and a pin extending downwardly from the vertical rear wall, and the horizontal PCB has a protrusion portion providing an additional area to form a connection point for electrically connecting the pin of the outer shell.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
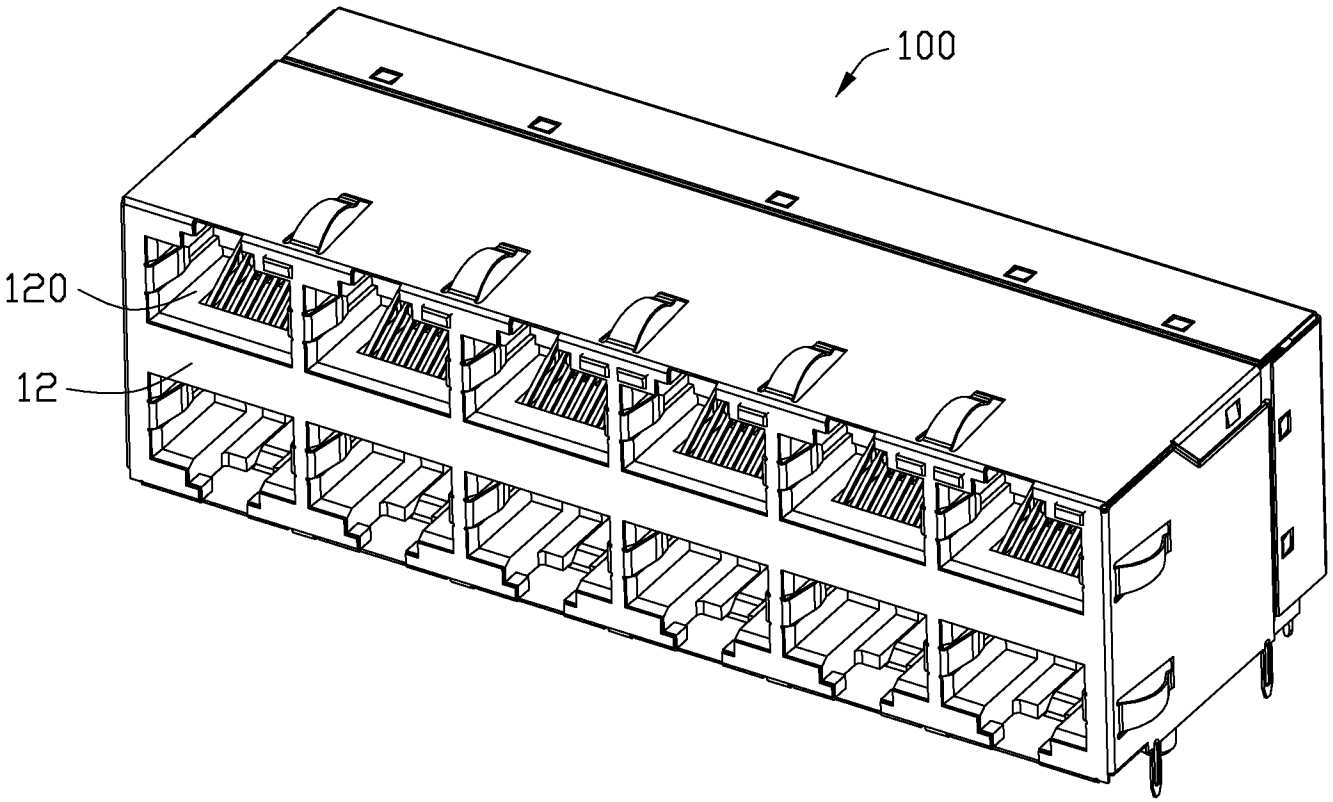
FIG. 1 is a perspective view of an electrical connector according to an embodiment of the present invention.
Figure 2:
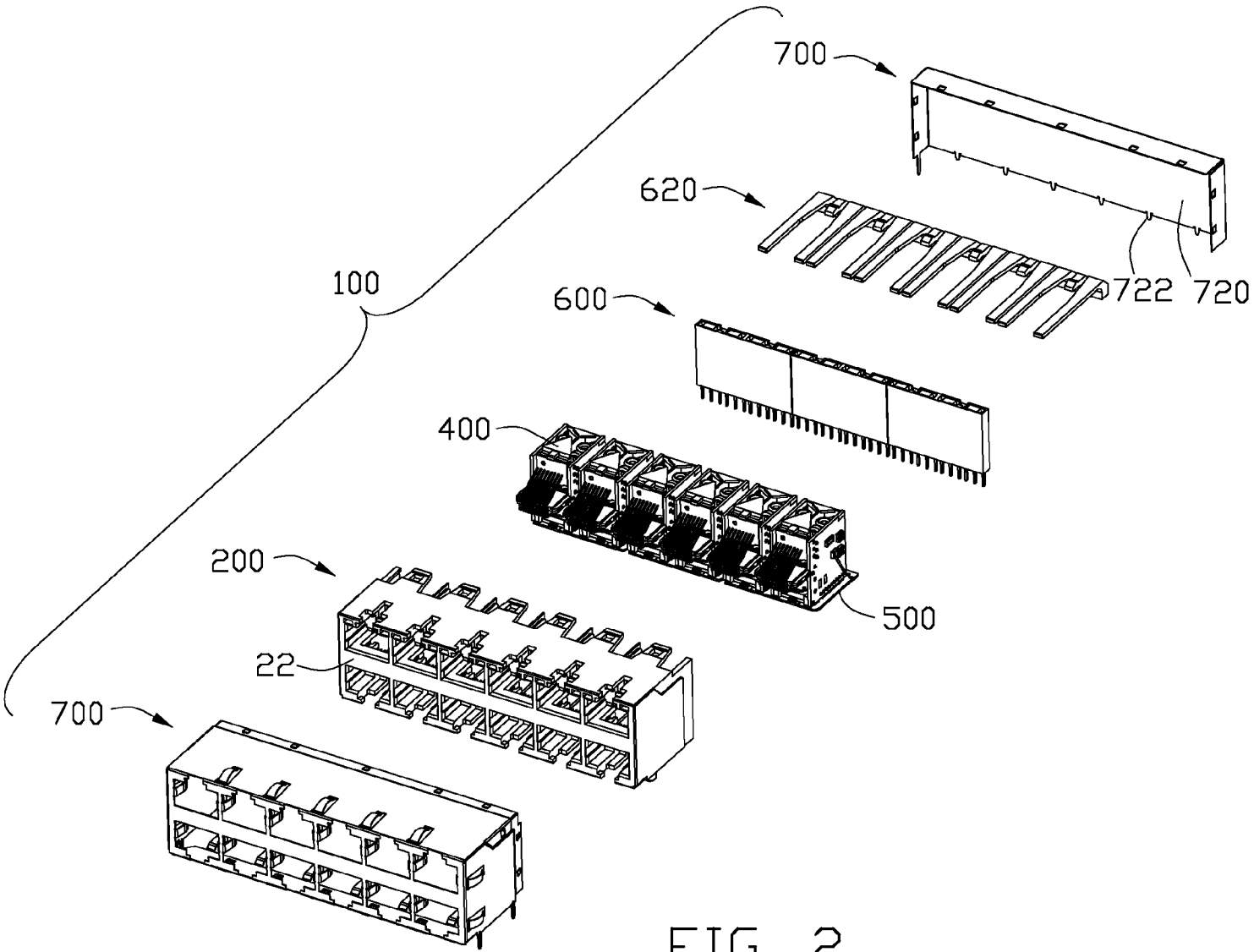
FIG. 2 is an exploded view of the electrical connector shown in FIG. 1.
Figure 3:
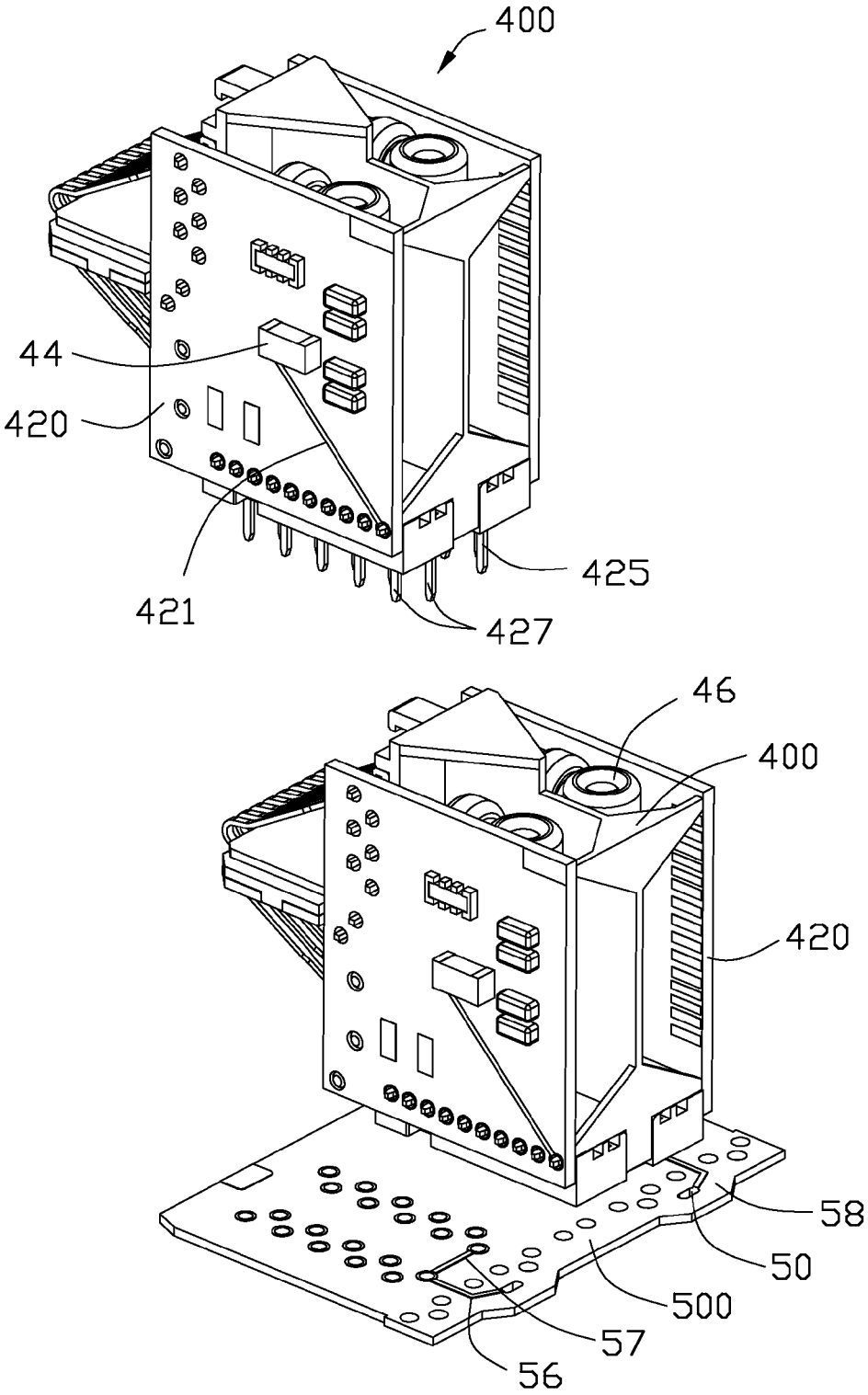
FIG. 3 is a perspective view of the electronic modules and the horizontal PCB.
Figure 4:
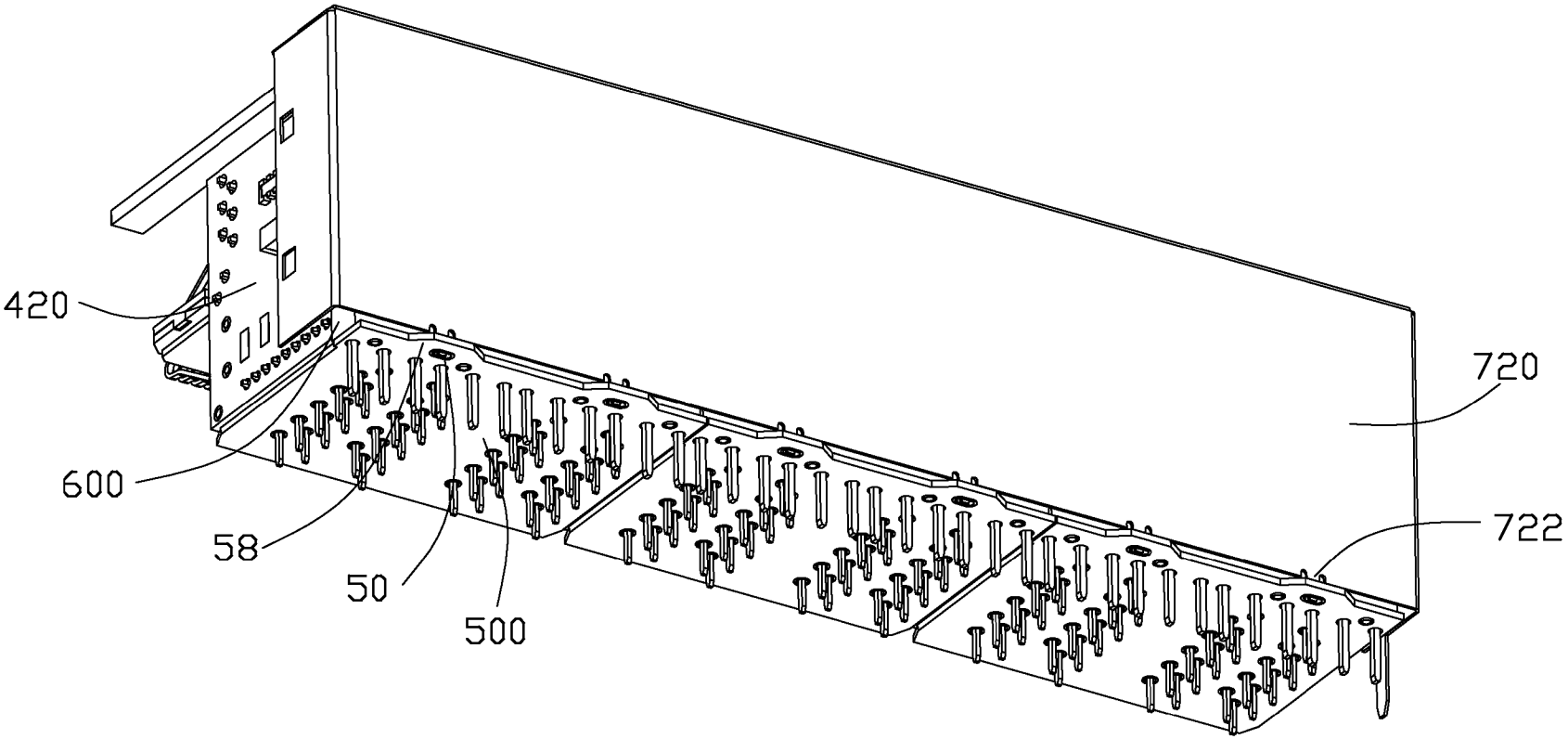
FIG. 4 is a back perspective view of the electrical connector shown in FIG. 1 with the housing is removed.

Reference will now be made to the drawing figures to describe the present invention in detail.

Referring to FIGS. 1-4, an electrical connector 100 of 2×N type modular jack is shown. The electrical connector 100 includes a housing 200, an electronic module 400 mounted to the housing 200, a bottom or horizontal PCB 500 mounted under the electronic module 400, an indicating device 600, 620, and an outer shell 700 covering the indicating device 600, 620, the electronic module 400, and the housing 200. The housing 200 defines a front face 22 and a first and a second rows of mating cavities recessed rearward from the front face 22 for receiving corresponding modular plugs (not shown). The first row of mating cavities are aligned with the second row of mating cavities one to one in a vertical direction. The electronic module 400 has a first and a second ground traces connect the outer shell 700 through a first and a second conductive traces 56, 57 of the horizontal PCB 500.

The electronic module 400 further includes a first and a second vertical PCBs 420 perpendicular to the front face; two groups of mating contacts respectively mounted on the first and the second vertical PCB 420 and extending into corresponding mating cavities; and two groups of conductors 425, 427 electrically connecting the vertical PCBs 420 and the horizontal PCB 500. The first ground trace includes a conductive trace 421 of the first vertical PCB 420 and one of said first plurality of conductors 427. The second ground trace includes a conductive trace 421 of the second vertical PCB 420 and one of the second group of conductors 425.

The horizontal PCB 500 defines a conductive through hole 50 electrically connecting the first conductive trace 56 of horizontal PCB 500. The outer shell 700 has a rear wall 720. The rear wall 720 forms a conductive pin 722 extending into the conductive through hole 50 and being electrically connected therein. The horizontal PCB 500 has a protrusion portion 58 extending rearward which provides an additional area to form the conductive through hole 50 that is aligned with the rear wall 720 of the outer shell 700 in the vertical direction.

Figure 5:
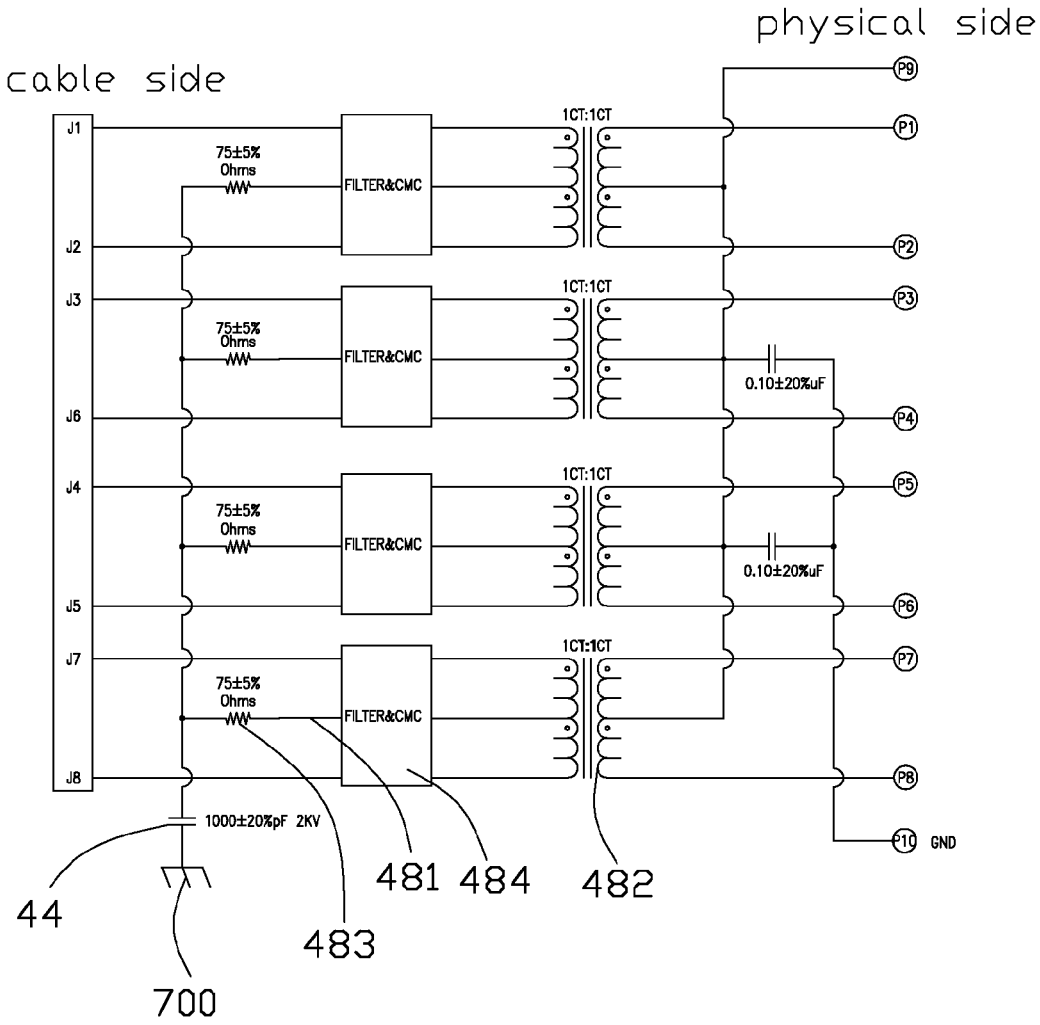
FIG. 5 is a schematic of the electrical connector shown in FIG. 1

The electronic module 400 forms a plurality of signal channels (referring to FIG. 5), each signal channel having a parallely connected transformer 482 and a serially connected common mode choke 484 mounted on the first vertical PCB 420. The transformer 482 and the common mode choke 484 are connected between a physic side and a cable side in the electronic module 400. The common mode choke 484 has a center tap 481 electrically connected a common signal of the common mode choke 484. The electronic module 400 further comprises a resistor 483 of 75 OHMS and a capacitor 44. The resistor is serially and electrically connected between the common center tap of common mode choke and a pole of the capacitor 44. An opposite pole of the capacitor 44 is electrically connected to the conductive trace 421 of the first or the second vertical PCBs 420.

The electrical connector 100 further comprises an indicating device 600, 620. The indicating device 600, 620 includes a light emitting device 600 mounted behind the electronic module 400 and a light guiding pipe 620 mounted in the housing 200. The outer shell 700 covers outside of the housing 200, the electronic module 400 and the indicating device 600, 620.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing defining a front face and a first mating cavity recessed rearward from the front face for receiving a modular plug;

an electronic module mounted to the housing;

a horizontal printed circuit board (PCB) mounted under the electronic module and having a first conductive trace;

an outer shell shielding the electronic module and the housing, the outer shell having a rear vertical wall; and an indicating device comprising a light emitting device disposed between the electronic module and the rear vertical wall of the outer shell; wherein the electronic module has a first ground trace connecting to the rear vertical wall of the outer shell through the first conductive trace of the horizontal PCB.

2. An electrical connector as claimed in claim 1, wherein the electronic module comprises: a first vertical PCB perpendicular to the front face and having a conductive trace; a first plurality of mating contacts mounted on the first vertical PCB and extending into said first mating cavity; and a first plurality of conductors electrically connecting the vertical PCB and the horizontal PCB, the first ground trace comprising the conductive trace of the first vertical PCB and one of said first plurality of conductors.

3. An electrical connector as claimed in claim 2, wherein the horizontal PCB defines a conductive through hole electrically connecting the first conductive trace of horizontal PCB, and the outer shell has a conductive pin extending into the conductive through hole and being electrically connected therein.

4. An electrical connector as claimed in claim 3, wherein said conductive pin extends downwardly from said rear vertical wall, and the horizontal PCB has a protrusion portion extending rearward providing an additional area to form the conductive through hole said conductive through hole.

5. An electrical connector as claimed in claim 2, wherein the housing defines a second recessed mating cavity stacked below the first mating cavity, and wherein the electronic module further comprises: a second vertical PCB parallel to the first vertical PCB; a second plurality of mating contacts mounted on the second vertical PCB and extending into said second mating cavity; a second plurality of conductors electrically connecting the second vertical PCB and the horizontal PCB; and wherein the electronic module has a second ground trace electrically connecting the outer shell through one of said second plurality of conductors and a second conductive trace of the horizontal PCB, the second ground trace comprising a conductive trace of the second vertical PCB and one of the second plurality of conductors.

6. An electrical connector as claimed in claim 2, wherein the electronic module further comprises a capacitor having a pole electrically connected to the first ground trace.

7. An electrical connector comprising:

an insulative housing (200) defining a plurality of mating cavities communicating forwardly with an exterior in a front-to-back direction;

a plurality of electronic modules (400) disposed in the corresponding cavities, respectively, each of said electronic modules (400) including a pair of vertical printed circuit boards (420) each having a capacitor (44);

a rear shell (700) covering rear sides of said electronic modules (400);

a plurality of horizontal printed circuit boards (500) side by side arranged with one another at a same level, each of said horizontal printed circuit boards (500) being located under a corresponding pair of said plurality of electronic modules (400) and defining linked first and second conductive traces (56, 57) thereon;

in each electronic module (400), a plurality of first conductors (427) connecting one of the pair of vertical printed circuit board (420) with the corresponding horizontal printed circuit board (500), and a plurality of second conductors (425) connecting the other of the pair of vertical printed circuit boards (420) with the corresponding horizontal printed circuit board (500); and the rear shell (700) defining a plurality of conductive pins (722) each mechanically and electrically connected to the corresponding horizontal printed circuit board (500); wherein in each horizontal printed circuit board (500) and the corresponding electronic module (400), the first conductive trace (56) connects the conductor pin (722) and one of the first conductors (427) which connects to the corresponding capacitor (44) on the same vertical printed circuit board (420) via another conductive trace (421), and the second conductive trace (57) connects said one of the first conductors (427) and one of the second conductors (425) which connects to the corresponding capacitor (44) on the same vertical printed circuit board (420) via another conductive trace (421).

8. The electrical connector as claimed in claim 7, wherein each of said electronic modules (400) is further accompanied with a set of indicating device (600) located between said electronic module (400) and the rear shell (700).

9. The electrical connector as claimed in claim 8, wherein each of said horizontal printed circuit boards (500) defines a row of through holes to couple to the corresponding indicating device (600), and the corresponding first conductive trace (56) extends across said row of through holes.

10. The electrical connector as claimed in claim 7, wherein in each f said electronic modules (400), said one of the first conductors (427) is a rearmost one thereof in said front-to-back direction, and said one of the second conductors (425) is a rearmost one thereof in said front-to-back direction.

* * * * *